US009448497B2

(12) United States Patent
Bellino et al.

(10) Patent No.: US 9,448,497 B2
(45) Date of Patent: Sep. 20, 2016

(54) OVERCOAT FORMULATION FOR LONG-LIFE ELECTROPHOTOGRAPHIC PHOTOCONDUCTORS AND METHOD FOR MAKING THE SAME

(71) Applicant: Lexmark International, Inc., Lexington, KY (US)

(72) Inventors: Mark Thomas Bellino, Loveland, CO (US); Gerald Hugh Ciecior, Westminster, CO (US); Douglas Jeffrey Harris, Louisville, CO (US); Weimei Luo, Louisville, CO (US); Brian David Munson, Mead, CO (US); Dat Quoc Nguyen, Platteville, CO (US); Scott Daniel Reeves, Louisville, CO (US); Tanya Yvonne Thames, Commerce City, CO (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 5 days.

(21) Appl. No.: 14/145,107

(22) Filed: Dec. 31, 2013

(65) Prior Publication Data

US 2015/0185642 A1 Jul. 2, 2015

(51) Int. Cl.
*G03G 5/05* (2006.01)
*G03G 5/147* (2006.01)

(52) U.S. Cl.
CPC ..... *G03G 5/0546* (2013.01); *G03G 5/14717* (2013.01); *G03G 5/14721* (2013.01); *G03G 5/14734* (2013.01); *G03G 5/14791* (2013.01); *G03G 5/14795* (2013.01)

(58) Field of Classification Search
CPC ..... G03G 5/14734; G03G 5/0546
USPC ..... 430/58.7, 66
See application file for complete search history.

(56) References Cited

U.S. PATENT DOCUMENTS 5,545,499 A 8/1996 Balthis
5,925,486 A 7/1999 Levin (Continued)

FOREIGN PATENT DOCUMENTS

JP 2000147813 A * 5/2000 ..... G03G 5/06
JP 2005049736 A * 2/2005 ..... G03G 5/047
JP 2008090118 A * 4/2008

OTHER PUBLICATIONS

English language machine translation of JP 2008-090118 (Apr. 2008).*

(Continued)

*Primary Examiner* — Christopher Rodee

(57) ABSTRACT

An overcoat layer and method to make an overcoated photoconductor drum of an electrophotographic image forming device using irradiation such as with electron beam (EB) or ultraviolet (UV) light is provided. The photoconductor drum is then cured using EB dose of between 10 and 100 kiloGrays (kGy), preferably between 20 and 40 kGys or UV irradiation with an exposure of between 0.1 and 2 J/cm$^2$. The unique overcoat layer of the present invention is formed having a biphasic morphology comprised of a highly cured crosslinked phase and a second phase enriched in uncured material. The desired amount of uncured uncrosslinked material found in the second phase of the biphasic structure, is between 2-70 wt % range, with particularly good combination of long-life and electrical performance when present at the 5-50 wt % level, and the best performance at the 15-40 wt % level. The biphasic morphology of the overcoat layer using the method of the present invention gives rise to the good wear rates while allowing rapid transport of the electrical charge and thus fast discharge properties of the photoconductor drum.

3 Claims, 5 Drawing Sheets

(56) References Cited

U.S. PATENT DOCUMENTS

| | | | | |
|---|---|---|---|---|
| 6,001,523 | A | 12/1999 | Kemmesat | |
| 6,004,708 | A | 12/1999 | Bellino | |
| 6,033,816 | A | 3/2000 | Luo | |
| 6,071,660 | A | 6/2000 | Black | |
| 6,232,025 | B1 | 5/2001 | Srinivasan | |
| 6,265,124 | B1 | 7/2001 | Luo | |
| 6,376,143 | B1 | 4/2002 | Neely | |
| 7,358,017 | B2 | 4/2008 | Reeves | |
| 7,387,861 | B2 | 6/2008 | Black | |
| 7,390,602 | B2 | 6/2008 | Reeves | |
| 7,416,823 | B2 * | 8/2008 | Yanagawa et al. | 430/58.7 |
| 7,642,027 | B2 | 1/2010 | Hartman | |
| 7,955,769 | B2 | 6/2011 | Black | |
| 7,960,081 | B2 * | 6/2011 | Orito et al. | 430/65 |
| 8,257,889 | B2 | 9/2012 | Cote | |
| 2004/0253527 | A1 * | 12/2004 | Suzuki et al. | 430/66 |
| 2007/0134570 | A1 | 6/2007 | Hartman | |
| 2014/0349227 | A1 * | 11/2014 | Nauka et al. | 430/56 |

OTHER PUBLICATIONS

English language machine translation of JP 2005-0497306 (Feb. 2005).*

English language machine translation of JP 2000-147813 (May 2000).*

* cited by examiner

OVERCOAT FORMULATION FOR LONG-LIFE ELECTROPHOTOGRAPHIC PHOTOCONDUCTORS AND METHOD FOR MAKING THE SAME

CROSS REFERENCES TO RELATED APPLICATIONS

None.

STATEMENT REGARDING FEDERALLY SPONSORED RESEARCH OR DEVELOPMENT

None REFERENCES TO SEQUENTIAL LISTING, ETC.

None

BACKGROUND

1. Field of the Disclosure

The present disclosure relates generally to overcoats for photoconductor drums and methods to form overcoats for photoconductor drums and more specifically to overcoats formed using ionizing irradiation, such as with an electron beam ('EB') or by gamma rays, or non-ionizing irradiation with ultraviolet ('UV') light. A long-life photoconductor to be used for electrophotographic printing is then produced.

2. Description of the Related Art

Electrophotographic photoconductors are typically comprised of a substrate, such as a metal ground plane member, on which a charge generation layer and a charge transport layer are coated. Recent improvements have added a protective overcoat layer applied over the charge transport layer of the photoconductor. These overcoats increase the lifetime of the photoconductor but can exhibit poor electrical performance. Accordingly, there is a need for a method to make an overcoat that can produce a drum with both long-life and good electrical characteristics.

SUMMARY

The present disclosure provides a method to make an overcoated photoconductor drum of an electrophotographic image forming device using irradiation such as with electron beam (EB) or ultraviolet (UV) light. A conventional photoconductor drum is dip coated with an overcoat formulation and dried. The photoconductor drum is then cured using EB dose of between 10 and 100 kiloGrays (kGy), preferably between 20 and 40 kGys or UV irradiation with an exposure of between 0.1 to 2 J/cm$^2$.

The overcoat of the present invention can be formed from polymerizable arylamines, such as arylamines with pendant acrylate, methacrylate, vinyl, or styrenyl groups. The overcoat can also be formed from a mixture of such polymerizable arylamines formulated with multifunctional non-arylamines. The inventors of the present invention have discovered a unique overcoat layer that is formed having a biphasic morphology comprised of a highly cured crosslinked phase and a second phase enriched in uncured material. This biphasic morphology can also be formed with non-arylamine monomers in conjunction with non-polymerizable arylamines. The desired amount of uncured uncrosslinked material found in the second phase of the biphasic structure, is be between 2-70 wt % range, with particularly good combination of long-life and electrical performance when present at the 5-50 wt % level, and the best performance at the 15-40 wt % level. The biphasic morphology of the overcoat layer using the method of the present invention gives rise to the good wear rates while allowing rapid transport of the electrical charge and thus fast discharge properties of the photoconductor drum. Therefore, this overcoat layer ultimately improves the lifetime of photoconductor drum from a typical value of 40,000 prints for uncoated drums, to well over 300,000 prints.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

Figure 1:
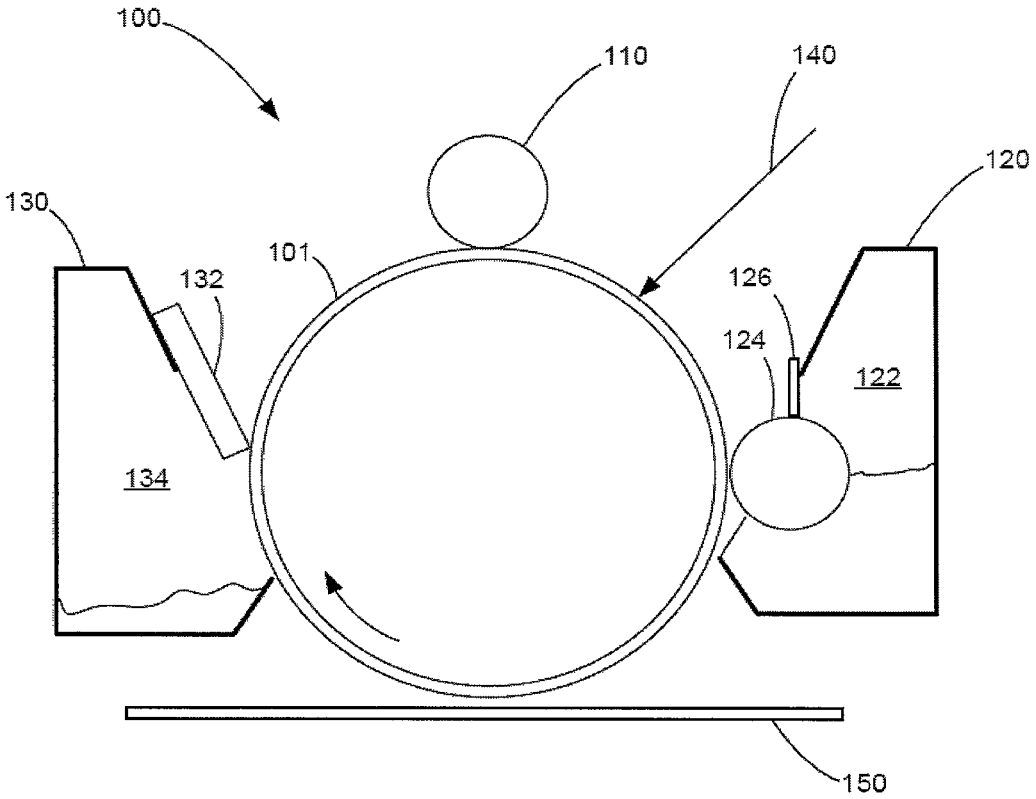
FIG. 1 is a schematic view of an electrophotographic image forming device.

It is to be understood that the disclosure is not limited in its application to the details of construction and the arrangement of components set forth in the following description or illustrated in the drawings. The disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Further, the terms "a" and "an" herein do not denote a limitation of quantity, but rather denote the presence of at least one of the referenced items.

FIG. 1 illustrates a schematic representation of an example electrophotographic image forming device 100. Image forming device 100 includes a photoconductor drum 101, a charge roll 110, a developer unit 120, and a cleaner unit 130. The electrophotographic printing process is well known in the art and, therefore, is described briefly herein. During a print operation, charge roll 110 charges the surface of photoconductor drum 101. The charged surface of photoconductor drum 101 is then selectively exposed to a laser light source 140 to form an electrostatic latent image on photoconductor drum 101 corresponding to the image being printed. Charged toner from developer unit 120 is picked up by the latent image on photoconductor drum 101 thereby creating a toned image.

Developer unit 120 includes a toner sump 122 having toner particles stored therein and a developer roll 124 that supplies toner from toner sump 122 to photoconductor drum 101. Developer roll 124 is electrically charged and electrostatically attracts the toner particles from toner sump 122. A doctor blade 126 disposed along developer roll 124 provides a substantially uniform layer of toner on developer roll 124 for subsequent transfer to photoconductor drum 101. As developer roll 124 and photoconductor drum 101 rotate, toner particles are electrostatically transferred from developer roll 124 to the latent image on photoconductor drum 101 forming a toned image on the surface of photoconductor drum 101. In one example embodiment, developer roll 124 and photoconductor drum 101 rotate in the same rotational direction such that their adjacent surfaces move in opposite directions to facilitate the transfer of toner from developer roll 124 to photoconductor drum 101. A toner adder roll (not shown) may also be provided to supply toner from toner sump 122 to developer roll 124. Further, one or more agitators (not shown) may be provided in toner sump 122 to distribute the toner therein and to break up any clumped toner.

The toned image is then transferred from photoconductor drum 101 to print media 150 (e.g., paper) either directly by photoconductor drum 101 or indirectly by an intermediate transfer member (not shown). A fusing unit (not shown) fuses the toner to print media 150. A cleaning blade 132 (or cleaning roll) of cleaner unit 130 removes any residual toner adhering to photoconductor drum 101 after the toner is transferred to print media 150. Waste toner from cleaning blade 132 is held in a waste toner sump 134 in cleaning unit 130. The cleaned surface of photoconductor drum 101 is then ready to be charged again and exposed to laser light source 140 to continue the printing cycle.

The components of image forming device 100 are replaceable as desired. For example, in one embodiment, developer unit 120 is housed in a replaceable unit with photoconductor drum 101, cleaner unit 130 and the main toner supply of image forming device 100. In another example embodiment, developer unit 120 is provided with photoconductor drum 101 and cleaner unit 130 in a first replaceable unit while the main toner supply of image forming device 100 is housed in a second replaceable unit. In another example embodiment, developer unit 120 is provided with the main toner supply of image forming device 100 in a first replaceable unit and photoconductor drum 101 and cleaner unit 130 are provided in a second replaceable unit. Further, any other combination of replaceable units may be used as desired. In some example embodiments, the photoconductor drum 101 may not be replaced and may be a permanent component of the image forming device 100.

Figure 2:
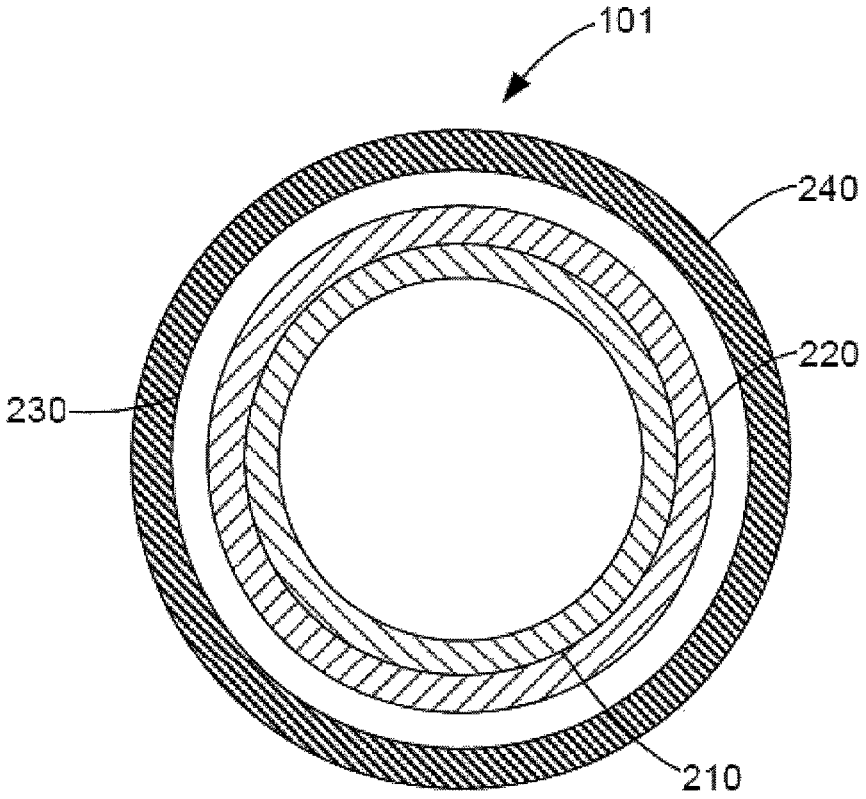
FIG. 2 is a sectional view of a replaceable unit of the electrophotographic image forming device.

FIG. 2 illustrates an example photoconductor drum 101 in more detail. In this example embodiment, the photoconductor drum 101 is an organic photoconductor drum and includes a support element 210, a charge generation layer 220 disposed over the support element 210, a charge transport layer 230 disposed over the charge generation layer 220, and a protective overcoat layer 240 formed as an outermost layer of the photoconductor drum 101. Additional layers may be included between the support element 210, the charge generation layer 220 and the charge transport layer 230, including adhesive and/or coating layers.

The support element 210 as illustrated in FIG. 2 is generally cylindrical. However the support element 210 may assume other shapes or may be formed into a belt. In one example embodiment, the support element 210 may be formed from a conductive material, such as aluminum, iron, copper, gold, silver, etc. as well as alloys thereof. The surfaces of the support element 210 may be treated, such as by anodizing and/or sealing. In some example embodiments, the support element 210 may be formed from a polymeric material and coated with a conductive coating.

The charge generation layer 220 is designed for the photogeneration of charge carriers—molecular and atomic particles, such as electrons and ions, which are free to move and carry electrical charges. The charge generation layer 220 may include a binder and a charge generation compound. The charge generation compound may be understood as any compound that may generate a charge carrier in response to light. In one example embodiment, the charge generation compound may comprise a pigment being dispersed evenly in one or more types of binders.

The charge transport layer 230 is designed to transport the generated charges from the charge generation layer 220 towards the surface of the photoconductor drum. The charge transport layer 230 may include a binder and a charge transport compound. The charge transport compound may be understood as any compound that may contribute to surface charge retention in the dark and to charge transport under light exposure. In one example embodiment, the charge transport compounds may include organic materials capable of accepting and transporting charges.

In an example embodiment, the charge generation layer 220 and the charge transport layer 230 are configured to combine in a single layer. In such configuration, the charge generation compound and charge transport compound are mixed in a single layer.

The overcoat layer 240 is designed to protect the photoconductor drum 101 from wear and abrasion without altering its electrophotographic properties, thus extending the service life of the photoconductor drum 101. The thickness of the overcoat layer 240 is kept at a range between 0.5 microns and as thick as 6.5 microns so as not to cause an adverse effect to the electrophotographic properties of the photoconductor drum 101. The overcoat layer 240 may include both binder and charge transport group components.

Preparation of Example Photoconductor Drum

An Example Photoconductor Drum was formed using an aluminum substrate, a charge generation layer coated onto the aluminum substrate, and a charge transport layer coated on top of the charge generation layer.

The charge generation layer was prepared from a dispersion including titanyl phthalocyanine (type IV or type I/IV mixtures), polyvinylbutyral, poly(methyl-phenyl)siloxane and polyhydroxystyrene at a weight ratio of 45:27.5:24.75:2.75 in a mixture of 2-butanone and cyclohexanone solvents. The polyvinylbutyral is available under the trade name BX-1 by Sekisui Chemical Co., Ltd. The charge generation dispersion was coated onto the aluminum substrate through dip coating and dried at 100° C. for 15 minutes to form the charge generation layer having a thickness of less than 1 μm, specifically a thickness of about 0.2 μm to about 0.3 μm.

The charge transport layer was prepared from a formulation including terphenyl diamine derivatives and polycarbonate at a weight ratio of 50:50 in a mixed solvent of THF and 1,4-dioxane. The charge transport formulation was coated on top of the charge generation layer and cured at 120° C. for 1 hour to form the charge transport layer having a thickness of about 17 μm to about 19 μm as measured by an eddy current tester.

To obtain the desired lifetime of the overcoated photoconductor drums, it is necessary to achieve wear rates of less than about 0.020\ μm per thousand pages printed (μm/kpg). At this level of wear it is possible to print 300,000 pages for a photoconductor drum 101 protected by a 6 μm-thick overcoat layer 240. Overcoat formulation were prepared by dissolving 25.0 g of isophorone diisocyanate bis(pentaerythritolacrylate) and 25.0 g of a triphenylamine dipropylacrylate in 100 ml isopropanol. 5 wt % 1-hydroxycyclohexyl phenyl ketone (CPK) was added as the photoinitiator to the formulations that were cured by ultraviolet (UV) light using a Fusion H-bulb with a maximum UVC irradiance at 254 nm. The overcoat formulation was then dip-coated onto the Example Photoconductor Drum prepared as outlined above, air dried to form a tacky coating, and then cured using EB or UV irradiance to form an overcoated photoconductor drum as outlined in the following examples.

EXAMPLES

Example 1

The overcoated Example Photoconductor Drum was placed in the EB unit and cured under nitrogen at 3 mA and 90 kV setting by exposing for 1.2 seconds to give a dose of 20 kGy to form a crosslinked overcoat layer. The cured Photoconductor Drum was then annealed at 120° C. for 60 minutes to yield a crosslinked overcoat layer with a thickness of approximately 4 microns.

Example 2

The overcoated Example Photoconductor Drum was placed in the electron beam unit and cured under nitrogen at 6 mA and 90 kV setting by exposing for 1.2 seconds to give a dose of 40 kGy to form a crosslinked overcoat layer. The cured Photoconductor Drum was then annealed at 120° C. for 60 minutes to yield a crosslinked overcoat layer with a thickness of approximately 4 microns.

Example 3

The overcoated Example Photoconductor Drum containing 5 wt % CPK was exposed to UV light for 2 seconds under a max irradiance of 0.6 W/cm$^2$ to form a crosslinked overcoat layer. The cured Photoconductor Drum was then annealed at 120° C. for 60 minutes to yield a crosslinked overcoat layer with a thickness of approximately 4 microns.

Example 4

The overcoated Example Photoconductor Drum containing 5 wt % CPK was exposed to UV light for 3 seconds under a max irradiance of 0.6 W/cm$^2$ to form a crosslinked overcoat layer. The cured Photoconductor Drum was then annealed at 120° C. for 60 minutes to yield a crosslinked overcoat layer with a thickness of approximately 4 microns.

Comparative Example A

The overcoated Example Photoconductor Drum was placed in the electron beam unit and cured under nitrogen at 15 mA and 90 kV setting for 1.2 seconds to give a dose of 100 kGy to form a crosslinked overcoat layer. The cured Photoconductor drum was then annealed at 120° C. for 60 minutes to yield a crosslinked overcoat layer with a thickness of approximately 4 microns.

Comparative Example B

The overcoated Example Photoconductor Drum was placed in the electron beam unit and cured under nitrogen with energy of under nitrogen at 15 mA and 90 kV setting for 2.4 seconds to give a dose of 200 kGy to form a crosslinked overcoat layer. The cured Photoconductor Drum was then annealed at 120° C. for 60 minutes to yield a crosslinked overcoat layer with a thickness of approximately 4 microns.

Comparative Example C

The overcoated Example Photoconductor Drum with 5 wt % CPK was exposed to UV light for 5 sec under an irradiance of 0.6 W/cm$^2$ to form a crosslinked overcoat layer. The cured Photoconductor Drum was then annealed at 120° C. for 60 minutes to yield a crosslinked overcoat layer with a thickness of approximately 4 microns.

From Table 1, it is observed in Examples 1 and 2 that a moderate EB dose of irradiation provides sufficient curing to obtain the desired wear properties (0.015 and 0.008 microns per 1000 pages, respectively). Table 1 also shows that curing the overcoat layer 240 with higher EB energy results in a higher degree of crosslinking and a lower wear rate. For Comparative Examples A and B, the wear rate is reduced to 0.007 and 0.004 microns per 1000 pages, respectively; however, the high level of curing resulted in poor print quality. Table 1 illustrates that the optimum amount of uncrosslinked material residing in the second phase of the biphasic structure or extractables' is between 5-40 wt %. Similar results were obtained by UV curing and examples are shown in Table 2.

TABLE 1

Performance of Overcoated Example Photoconductor Drums, subjected to varying amounts of EB curing.

| | Dose (kGy) | Print Quality | Avg Wear Rate microns/k page | Extractables (wt. %) |
|---|---|---|---|---|
| Example 1 | 20 | Good | 0.015 | 32 |
| Example 2 | 40 | Good | 0.008 | 6 |
| Comp. Example A | 100 | Poor | 0.007 | <1 |
| Comp. Example B | 200 | Poor | 0.004 | <1 |

Extractables are defined as the wt % of total material dissolved by chloroform. Wear rate data was obtained from a Lexmark C792 printer.

TABLE 2

Performance of Overcoated Example Photoconductor Drums, subjected to varying amounts UV curing.

| | Exposure Time (sec) | Print Quality | Avg Wear Rate microns/k page | Extractables (wt. %) |
|---|---|---|---|---|
| Example 3 | 2 | Good | 0.012 | 8 |
| Example 4 | 3 | Good | 0.008 | 6 |
| Comp. Example C | 5 | Poor | Not tested | 1.4 |

Extractables are defined as the wt % of total material dissolved by chloroform. Wear data was obtained from a CS510 printer.

Figure 3:
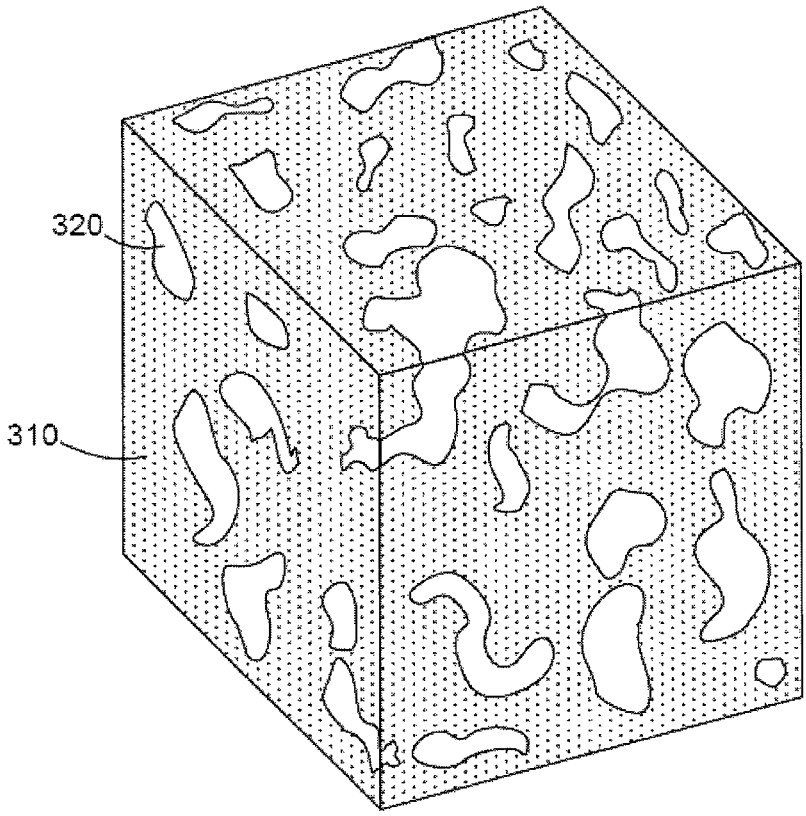
FIG. 3 is an illustration of the overcoat morphology.

The good electrical performance and desired wear rate of the drums in the examples were determined to arise from the unique morphology of these drums. FIG. 3 is an illustration representing this morphology. The overcoat has a biphasic structure, with a continuous matrix 310 of highly cured, crosslinked resin and second phase 320 enriched in unreacted uncured material.

The amount of extractable free small molecules, that is, uncured uncrosslinked material, may be determined by soaking the coating in chloroform for 1 hour and analyzing the extract by $^1$H NMR, GPC and LC/MS analyses. The $^1$H NMR procedure was found to be most accurate for quantifying the amount of free material. In Table 1, Examples 1 and 2 were determined to contain 32 and 6 wt % extractables, respectively. By comparison, the poorly performing comparative Examples A and B had less than 1 wt % of extractable monomers. The drums in Example 1 and 2 achieve such unexpected long life times and low wear rates despite the presence of high levels of small molecules. Similar results were obtained by curing with UV light. This observation is explainable by the biphasic structure of the overcoat drum. The amount of uncrosslinked material, residing in the second phase of the biphasic structure, for an example was found to be in the 2-70 wt % range, with particularly good combination of long-life and electrical performance when present at the 5-50 wt. % level, and the best performance at the 15-40 wt. % level, such as from about 20 wt % to about 40 wt %.

Figure 4:
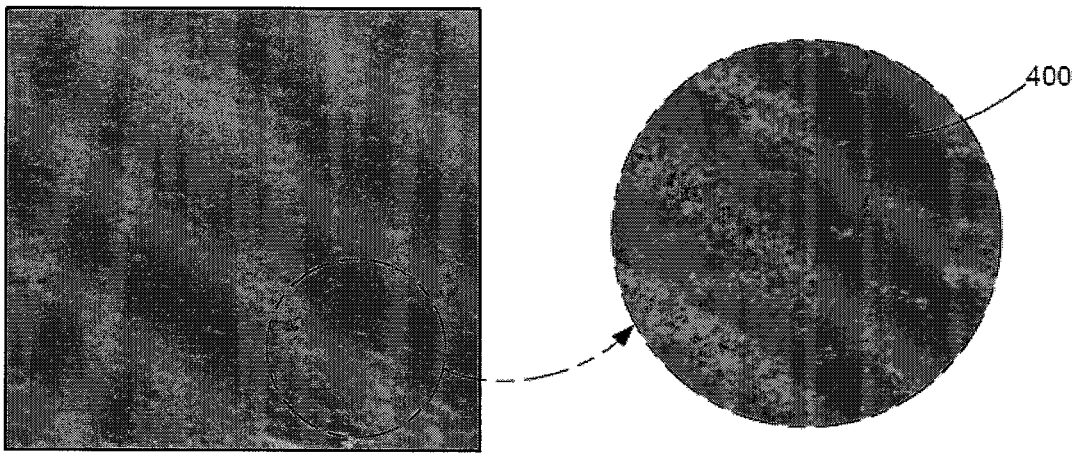
FIG. 4 is a scanning electron microscopy (SEM) image of the surface of the extracted overcoat cured by electron beam (EB).

Scanning electron microscopy further confirms the biphasic nature of the overcoat material. The surface of the extracted overcoat in Example 1 is shown in FIG. 4. The enlarged section reveals nanopores 400 left behind in the overcoat matrix after the transport phase, that is, the biphasic domains 320 of uncrosslinked molecules, has been extracted. The nanopores 400 left behind are on a size of approximately 50 nm. These nanopores 400 are particularly desirable in providing uniform electrical properties and good wear rates; however, if the nanopores 400 are too large, the wear rates will suffer due to poor structural integrity. That the mild curing conditions could produce this type of architecture is unforeseen. Similar results were obtained upon exposure to UV light as shown in Example 5.

Figure 5:
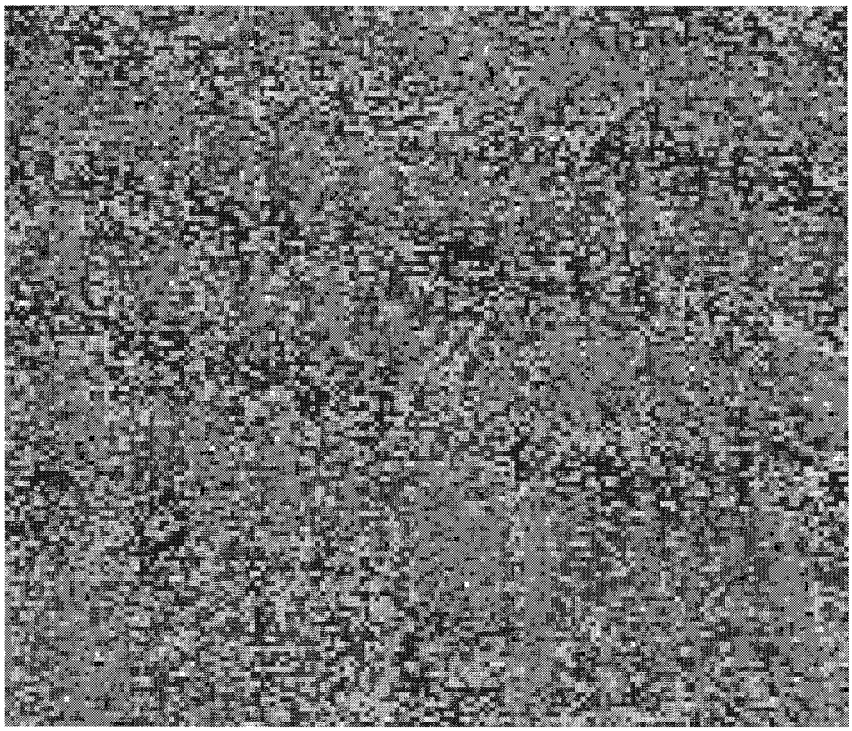
FIG. 5 is a scanning electron microscopy (SEM) image of the surface of the extracted overcoat cured by ultraviolet (UV) light.

The overcoat may be formed by either spraying or dip coating a base drum with the polymerizable arylamine material. In the case of dip coating, the solvent must be carefully selected to a) dissolve the unpolymerized overcoat material and b) not damage the underlying coatings on the base drum. Various coating additives, such as wetting agents, fillers, and leveling agents that may contain acrylate, methacrylate, vinyl, or styrenyl groups can be combined with this invention to obtain superior overcoat performance. The overcoat achieves the electrical properties when the uncrosslinked material is present as a continuous phase. This biphasic structure, surprisingly, can be formed by exposing a coating comprised of at least one polymerizable arylamine compound to a short duration of exposure to either EB or UV light. Suitable thermal initiators may also be employed to obtain the desired structure. Careful tuning of the amount of irradiation allows the ideal structure to be formed with a significant amount of uncured unreacted material. The removal of the uncured unreacted material by extraction with chloroform causes the sponge appearance in the SEM image as shown in FIGS. 4 and 5.

In an example embodiment, the curable polymerizable arylamine material includes polymerizable arylamines such as arylamines with pendant acrylate, methacrylate, vinyl, or styrenyl groups. The following partial structures are particularly suitable for use as polymerizable arylamine acrylates.

I

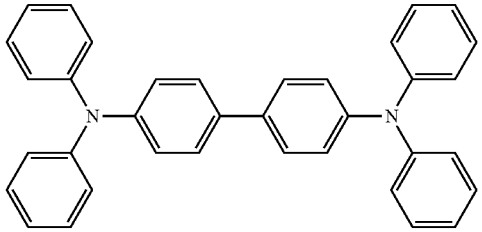

II

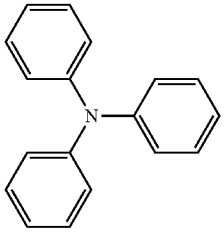

-continued

III

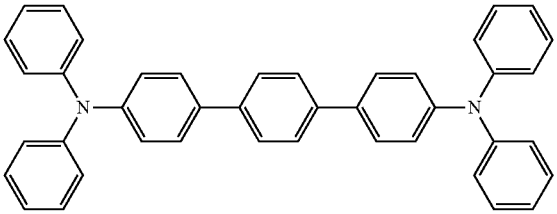

IV

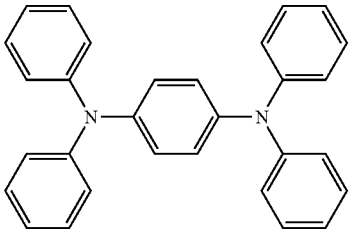

V

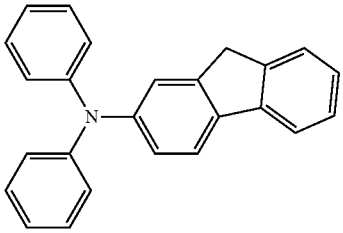

IVI

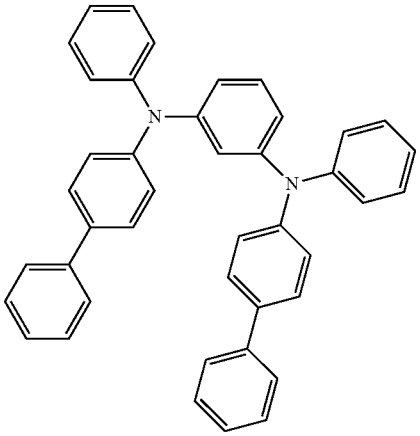

The polymerizable component may specifically include $CH_2{=}CHCOO{-}$, $CH_2{=}C(CH_3)COOCH_2{-}$, $CH_2{=}C(CH_3)COOCH_2CH_2{-}$, $CH_2{=}C(CH_3)COOCH_2CH_2CH_2{=}C(CH_3)COOCH_2CH_2CH_2{=}CH{-}$, or $CH_2{=}CH{-}C_6H_5{-}$ attached to the partial structures above.

The molecules are derivatives that contain one or more polymerizable side groups. Acrylates have been found to be a preferable substitution. A spacer between the aromatic ring(s) and the polymerizable unit has been found to improve crosslinkability. Spacers of ethyl and propyl groups have been found to have most desirable results. The aromatic rings may also be optionally substituted with one or more non-polymerizable groups. Methyl constituents have been found to provide improved durability and are thus particularly desirable.

In an example embodiment, the polymerizable arylamine material can also be comprised by a mixture of such polymerizable arylamines formulated with multifunctional non-arylamines, such as the hexafunctional acrylate. The desired structure can also be obtained by curing non-arylamine monomers in conjunction with non-polymerizable arylamines, including urethane acrylates and urethane methacrylates.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

What is claimed is:

1. A photoconductor drum, comprising:

a support element;

a charge generation layer disposed over the support element;

a charge transport layer disposed over the charge generation layer; and an overcoat layer, disposed over the charge transport layer, comprising a curable polymerizable arylamine material, wherein the polymerizable arylamine material includes at least one pendant acrylate, methacrylate, vinyl, or styrenyl group, and wherein the overcoat layer has a biphasic overcoat structured comprised of a highly cured crosslinked phase and a second phase having an amount of uncured uncrosslinked material, between about 20% to about 40 wt %.

2. The photoconductor drum of claim 1, further comprising of at least one of wetting agents, fillers, and leveling agents.

3. The photoconductor drum of claim 1, wherein the polymerizable arylamine material, with at least one or more pendant acrylate, methacrylate, vinyl, or styrenyl group, comprises arylamines of one or more partial structures (I-VI):

I

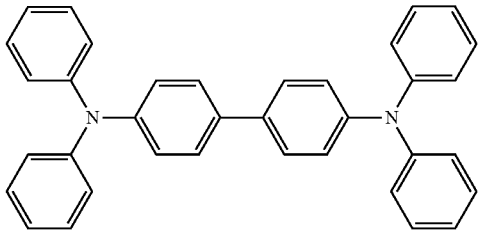

II

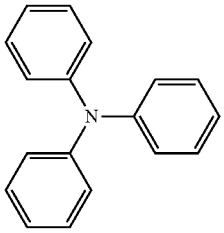

-continued

III

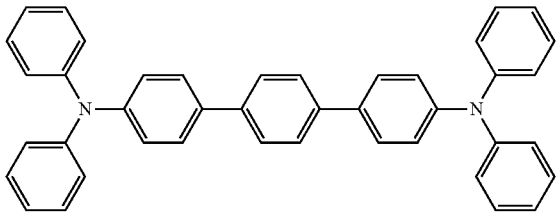

IV

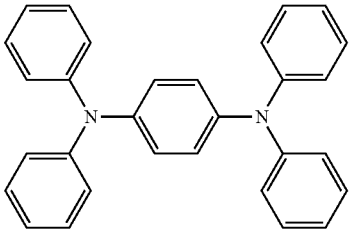

V

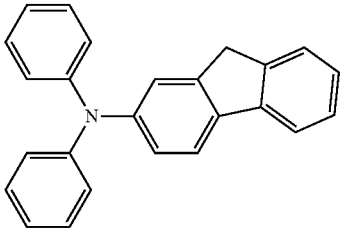

VI

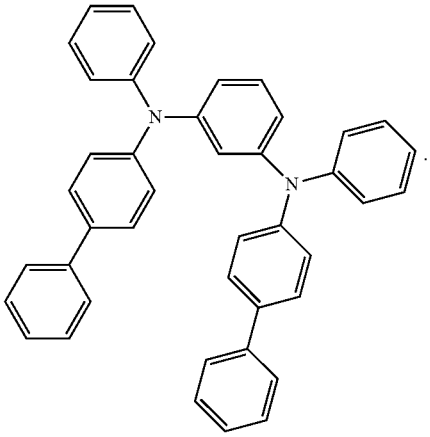

* * * * *